United States Patent [19]

Davis

[11] 4,116,743

[45] Sep. 26, 1978

[54] NYLON OR POLYESTER SLIP SET FABRIC CHEMICALLY TREATED TO ADHERE NEOPRENE, EPDM OR BUTYL FILM

[75] Inventor: Delbert A. Davis, Kernersville, N.C.

[73] Assignee: Burlington Industries, Inc., Greensboro, N.C.

[21] Appl. No.: 790,872

[22] Filed: Apr. 26, 1977

[51] Int. Cl.[2] ..... C09J 5/06

[52] U.S. Cl. ..... 156/333; 156/110 A; 156/315; 260/29.7 R; 260/29.7 H; 427/390 R; 427/412; 427/400; 428/247; 428/474; 428/255; 428/483; 428/420

[58] Field of Search ..... 156/88, 315, 110 A, 156/333; 427/390 R, 400, 412; 428/247, 474, 255, 483, 420; 252/8.6; 8/115.6; 526/295; 260/29.7 R, 29.7 H

[56] References Cited

U.S. PATENT DOCUMENTS

| | | | |
|---|---|---|---|
| 2,436,222 | 2/1948 | Neal et al. | 156/110 A |
| 2,773,795 | 12/1956 | Reynolds | 260/29.7 H |
| 3,060,070 | 10/1962 | Atwell | 156/333 |
| 3,060,078 | 10/1962 | Atwell | 156/333 |
| 3,240,649 | 3/1966 | Atwell | 156/315 |
| 3,240,651 | 3/1966 | Atwell | 156/110 A |
| 3,361,693 | 1/1968 | Geschwind | 156/333 |
| 3,758,362 | 9/1973 | Brown | 156/333 |
| 3,826,772 | 7/1974 | Gebhard et al. | 156/333 |

*Primary Examiner*—William A. Powell
*Assistant Examiner*—J. J. Gallagher
*Attorney, Agent, or Firm*—Cushman, Darby & Cushman

[57] ABSTRACT

A method is disclosed for adhesively securing an open mesh, woven nylon or polyester scrim fabric to avoid distortion or movement of the individual yarns or thread members of said fabric said method comprising applying to said fabric a coating of a dispersion of a carboxylated copolymer of chloroprene and methacrylic acid and drying said coating thereby bonding the warp and fill yarns of said fabric together at their cross over points.

2 Claims, 3 Drawing Figures

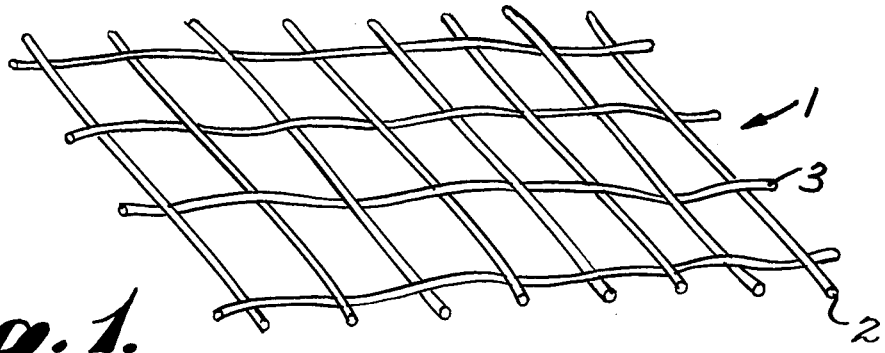
Fig. 1.
Fig. 2.
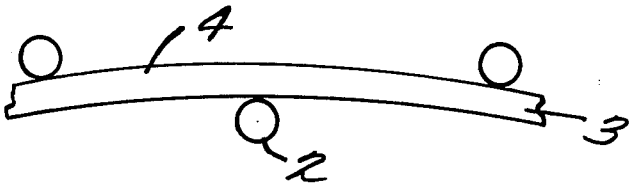
Fig. 3.
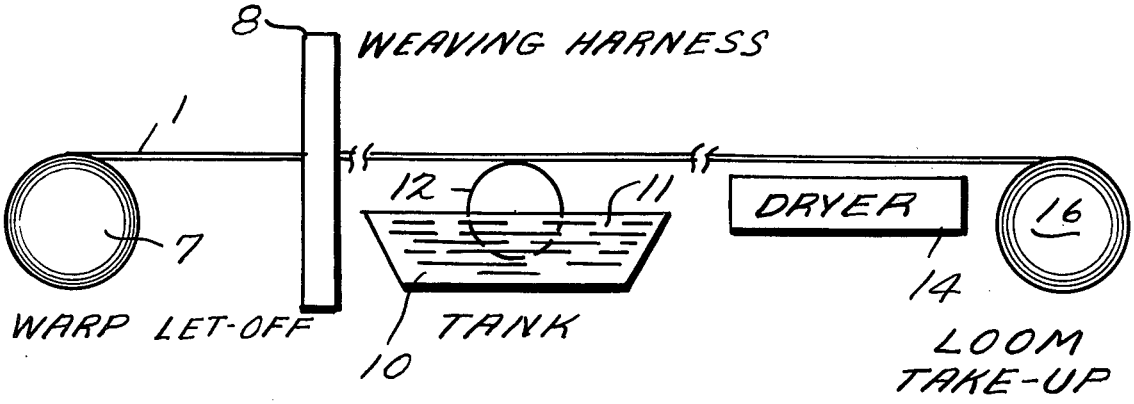

NYLON OR POLYESTER SLIP SET FABRIC CHEMICALLY TREATED TO ADHERE NEOPRENE, EPDM OR BUTYL FILM

BACKGROUND OF THE INVENTION

This application relates to a process for producing a slip set scrim fabric properly coated or bonded to prevent the warp and filling threads in the woven construction from slipping out of position with respect to each other. Such slip set scrims or open mesh plain weave fabrics are usually categorized in the trade as having interstices of one-sixteenth inch or more. A principle object of the present invention is to provide a process for securing the warp and filling threads of scrim fabrics together so that the resulting product may be handled and worked without distortion of the fabric weave.

Cotton scrims have been used for many years as tobacco cloth, backing for wall coverings, polishing cloths, mosquito netting, medical gauzes, fabric laminates and food covers, while synthetic scrim fabrics have been used to support vinyl films in waterproof covers for trucks, tents, air structures and pool liners. Common manufacturing procedure is to weave a predetermined scrim fabric pattern or construction and provide it with an appropriate bonding agent all at one plant location; the bonded fabric is then shipped to the processor for inclusion into the final product, for instance rubber hoses and tubing. Bonding materials such as starch, gums, polyvinyl acetate, vinyl/acrylic copolymer and polyvinyl chloride have been used by the fabric producer to enable shipment to the processor without distorting the pattern of the bonded goods.

Choice of a particular sizing composition depends upon the end use of the fabric in much the same manner as is the choice of a given fiber used in the construction of the fabric itself. As a general rule there is no intentional chemical bonding of the film to the scrim fabric, so that tear strengths of the laminate are not impaired by the fabric-to-film adhesion.

The following is a collection of U.S. patents relating to scrim fabrics and their end uses: U.S. Pat. Nos. 3,255,030; 3,602,636; 3,623,937, 3,868,985; 3,901,755; 3,914,495; 3,928,110; and 3,956,569.

DETAILED DESCRIPTION OF THE INVENTION

I have now discovered and hereby disclose a process for producing an improved slip set scrim fabric having excellent yarn cross-over adhesion which, when subjected to finishing conditions, exhibits chemical bonding with the substrate to which it is laminated. My invention includes providing a nylon or polyester synthetic slip set scrim fabric with a coating of a carboxylated neoprene compound that provides good cross-over adhesion to the scrim after it is coated and improved adhesion of the thus-coated fabric with a rubber substrate to which it is laminated. In one embodiment of my invention the scrim is treated on the loom with an aqueous-based adhesive material of the type described to bond the warp and filling yarns together at the cross-over points. The resulting slip set scrim exhibits improved adhesion with the substrate to which it is laminated.

The present invention is specific to the types of scrim fabric that are coated; they include nylon and polyester, both of which are synthetic fabrics, as opposed to natural fabrics such as cotton, wool or the like. Nylons and polyesters of various grades and origins are suitable according to the present process so long as the fabric is capable of chemically bonding to the coating compositions applied thereto under the processing conditions, as described in more detail below.

According to my process, the fiber of a fabric of relatively open mesh construction is adhered or bonded at the yarn cross-over points for shipment from the weaving plant or loom area to a manufacturing area or plant without individual yarn bundles becoming dislodged. The slip set scrim is then laminated to a suitable substrate in the manufacturing plant. In use under normal rubber curing conditions the applied coating compositions chemically bond to the yarn bundles, and thus promote adherence of various rubbers, i.e., neoprene, EPDM, butyl rubber and the like, to the coated scrim fabric.

FIG. 1 illustrates a typical open mesh scrim fabric 1 composed of warp 2 and fill 3 yarns, either of polyester or nylon.

FIG. 2 is a close-up representation showing the coating composition or "slip set" 4, enlarged for illustrative purposes, bonded to the scrim on the warp and fill yarns, 2 and 3, respectively. The warp and fill strands are bonded together with the adhesive composition at the yarn cross-over points.

FIG. 3 is a schematic representation of the cross section of a typical coating operation.

Scrim fabric 1 from the loom (not shown) is taken from the warp let-off 7, through a reed 8 and contacted with the coating composition of slip set in the assembly by a dip tank 10 traversing the width of the fabric 1. The dip tank contains the coating composition 11 and a roller 12 partially submerged in the coating composition and contacting the scrim fabric 1. As the fabric 1 passes over and contacts the roller 12, the coating composition is applied to the scrim fabric, usually under ambient conditions. The thus coated, wet fabric is passed over dryer 14 and taken up on loom take-up roll 16. Dryer 14 may be omitted, if desired, and the slip set dried in air or a plurality of dryers may be used. In operation, the coating is usually dried at a temperature of between 150°–175° F. which serves to mechanically secure the warp and fill yarn bundles together to a sufficient degree for further handling and processing.

The slip set scrim fabric is removed from the weaving and coating area and usually transported to another area or manufacturing plant where the end use products are fabricated. Preferred end uses are hoses and tubing and also include potato dams, where the fiber supports a film laminated onto it, air tents or other consumer or industrial products where one or more layers of film are laminated or calendered to one or both sides of the slip set scrim.

While the above illustrative embodiment is directed to the application of the slip set coating compositions to the dry scrim fabric as part of the weaving operation, it will be understood that the invention also includes applying the coating compositions to the dry scrim fabric as a separate dipping operation. Thus the scrim can be woven and stored in the dry state then, in a separate operation, the slip set applied thereto. However, it is preferred to handle the dry scrim as little as possible such that application of the slip set composition subsequent to scrim weaving is desirable to mechanically secure the warp and fill yarn bundles together.

Chemical bonding between the coating composition and the scrim fabric usually occurs in the final processing areas. Using a carboxylated neoprene coating composition as an example, it is believed that the carboxyl groups of the coating composition join the nylon or polyester fiber of the scrim to the rubber-like neoprene elastomer at elevated temperatures of about 310° to 325° F. encountered during laminating or processing operations. It is to be understood that a wide range of temperatures may and are employed, ranging from about 225° F. up to a temperature nearing the fusion point of the nylon or polyester fabric itself. Thus the desired chemical bonding occurs as the scrim fabric is laminated or processed with one or more other materials under customary processing conditions including heating and curing. This chemical bonding, in turn, promotes adherence of the slip set scrim fabric to the laminated substrate.

By virtue of the chemical bonding improved products are fabricated, advances in peel adhesion and edge pull being primarily noted as illustrated in the following examples.

Various coating compositions or slip sets may be employed according to the processes of the present invention provided chemical bonding is achieved, under heating and curing conditions, in the final product. These coating compositions are based upon a reactive elastomer, carboxylated neoprene latices, EPDM, butyl rubber and polychlorosulfonated polyethylene (Hypalon being considered illustrative). Other conventional formulating and/or processing adjuvants are normally included in the compositions such as stabilizers, thickeners, humectants, emulsifiers, in association with the primary vehicle which is usually water.

Carboxylated neoprene latices are an especially preferred class of materials. These latices are aqueous dispersions of chloroprene, as the primary monomer, with methacrylic acid as a comonomer present in an amount of about 5 percent by weight or less, preferably about 2 to about 4 weight percent. The monomers are mixed together in a solution, usually aqueous, with polyvinyl alcohol (PVA) as a colloid protectant and as a portion of the emulsifier, or other emulsifier or emulsifiers of the nonionic or anionic type. Such materials, in addition to the two monomers, are commonly referred to as stabilizers for the latex system; preferred materials include the alkylaryl polyether alcohols (Triton X-100 and X-155, Rohm and Haas), non-phenoxy poly(ethyleneoxy) ethanol (CO-880, GAF) and polyvinyl alcohol.

Two particularly suitable latices are available from E. I. duPont de Nemours and Company under the trade designations Neoprene Latex 101 and Neoprene Latex 102. Both products contain chloroprene, methacrylic acid, PVA and are supplied as nonionic latices, as described above. They have a carboxyl functionality of 0.033/100 grams of latex solids (mol carboxyl/kg latex solids = 0.33) and are characterized by the following properties:

| Property | L - 101 | L - 102 |
|---|---|---|
| chlorine content (%) | 36 | 36 |
| pH (at 25° C) | 7.0 | 7.0 |
| standard solids (% by weight) | 46 | 46 |
| specific gravity at 25° C | | |

-continued

| Property | L - 101 | | | L - 102 |
|---|---|---|---|---|
| polymer | 1.24 | | | 1.24 |
| latex | 1.08 | | | 1.08 |
| average particle size (microns) | 0.3 | | | 0.3 |
| Brooksfield viscosity at 25° C, cps. | | | | |
| viscosity | 500 | 350 | 400 | 250 |
| spindle | #2 | #2 | #2 | #2 |
| speed (r/m) | 6 | 30 | 6 | 30 |

It is understood that L-102 is a lower molecular weight version of L-101.

The weight percent of solids in the coating compositions of the present invention may range up to 50% or greater, preferably between about 26 and 29%. The upper limit is dependant upon the solids content of the particular elastomer employed. For example, the preferred carboxylated neoprene compounds are commercially available in a 46% solids content aqueous latex, thus for these materials 46% in the upper limit. Materials such as clays, carbon blacks and pigments can be used to raise the solids content of the coating compound or to give a definite color to the coating compositions. These materials are sometimes used to obtain latex solids far above compositions. The solids of the basic latex composition ranging from 5 to 85 percent of the coating composition. In practice lower concentrations are employed by approximate dilution and/or modification of the elastomer composition as indicated.

Process adjuvants are customarily included with the latex itself to improve the composition cure and/or adhesion so as to promote better cross-linking. In the following examples hexanol methanol melamine, identified as Cymel 303, was employed although other methanol melamines are contemplated. Stabilizing salts or emulsifiers such as nonionic or anionic surfactants may be included in the coating composition in amounts up to about 1 weight percent, preferably about 0.1 weight percent. Glycol is illustrative of an acceptable humectant and composition thickness include E678 Rhoplex, carboxy methylcellulose, acrylic acid and methacrylic acid.

In the following examples all parts and percentages are by weight unless otherwise indicated.

EXAMPLES 1–2

The following fabrics were prepared and coated with a carboxylated chloroprene compound, identified as neoprene 101 above, and applied to both nylon and polyester fabrics. The following results were obtained:

| Example | Fiber | Count warp | Count fill | denier | Greige adhesion | Slip Set adhesion |
|---|---|---|---|---|---|---|
| 1 | nylon | 13.5 | 14.0 | 840 | 10 | 33 |
| 2 | poly-ester | 10.0 | 10.0 | 1000 | 12 | 23 |

EXAMPLES 3–10

Additional runs were made on the fabrics of the preceding examples with various solids contents; in Examples 4 and 5 a melamine-based cross-linking agent was included in the formulation and further improvements in both adhesion and edge pull were observed.

| | Example Numbers | | | | | | | |
|---|---|---|---|---|---|---|---|---|
| | 3 | 4 | 5 | 6 | 7 | 8 | 9 | 10 |
| Composition | | | | | | | | |
| Neoprene 101 (46% solids) | 100 | 100 | 100 | 100 | 100 | 100 | 100 | 100 |
| Cymel 303 | — | — | 1.5 | 1.5 | — | — | — | — |
| Water | 93.0 | 93.0 | 93.0 | 93.0 | 73.0 | 73.0 | 58.0 | 58.0 |
| % solids | 23.3 | 23.3 | 24.4 | 24.4 | 26.5 | 26.5 | 29.1 | 29.1 |
| Peel Adhesion | | | | | | | | |
| Nylon | 25 | — | 25/35 | — | 23 | — | 34/42 | — |
| Polyester | — | 23 | — | 26 | — | 25 | — | 25 |
| Edge Pull (Grams) | | | | | | | | |
| Nylon | 105/70 | — | 85/60 | — | 85/115 | — | 90/40 | — |
| Polyester | — | 55/60 | — | 110/90 | — | 35/65 | — | 25/52 |
| add on (grams/yd$^2$) | | | | | | | | |
| Nylon | .96 | — | 1.00 | — | 1.02 | — | 1.00 | — |
| Polyester | — | 0.54 | — | 0.51 | — | 0.52 | — | 0.52 |
| % add on | | | | | | | | |
| Nylon | 23.8 | — | 24.6 | — | 25 | — | 24.6 | — |
| Polyester | — | 17.1 | — | 16.3 | — | 16.6 | — | 16.6 |

EXAMPLES 11-14

Additional coating compositions were formulated and again applied to both of the fabrics of Example 1 this time using increased amounts of the cross-linking agent. The formulations and results obtained are as follows:

| | Example No. | | | |
|---|---|---|---|---|
| | 11 | 12 | 13 | 14 |
| Compositions | | | | |
| Neoprene 101 (46% solids) | 100 | 100 | 100 | 100 |
| Cymel 303 | 1.5 | 1.5 | 3.0 | 3.0 |
| Water | 93.0 | 93.0 | 93.0 | 93.0 |
| % solids | 24.3 | 24.3 | 24.6 | 24.6 |
| Peel adhesion | | | | |
| nylon (Example 1) | 33D | — | 33/40D | — |
| polyester (Example 2) | — | 19/27D | — | 20/26D |

The peel adhesion testing procedure used in the foregoing examples is as follows: This test is to determine the adhesion of rubber and rubber-like materials to fabrics. Two 4 inch by 8 inch pieces were cut from the swatch to be tested; the 8 inch cut was made in the warp direction.

A ply of the pieces was made by placing one piece of rubber 4 inches by 4 inches on each side and between the two fabric pieces. The pieces of fabric were positioned so that the test swatch face is exposed to the center separating rubber piece, and the back of the test swatch is also exposed to the center separating rubber. Holland cloth was used on each side of the ply to prevent sticking to the press platten.

The ply was then cured in a press for a period of 30 minutes at a temperature of 300° F. ± 2° and a platten pressure 125 psi. The cured ply was removed from the press and allowed to cool and condition to room temperature for at least 20 minutes. The sample was cut to a width of exactly one inch and a length of at least 6 inches; the cut followed a warp yarn.

The cut ply was clamped in a tensile tester set at a pull rate of two inches per minutes. The ply was secured in the jaws of the tester so that the fabric peeled from the separating rubber piece. Next the tester was started and allowed to peel for a distance of three-fourths of an inch then a reading was taken. The separating rubber piece was cut with a knife so that it peeled from one piece of fabric only and the average tensile strength reading for a distance of 1 inch was recorded.

Next the separating rubber piece was cut so that the rubber peeled from the other piece of fabric. An average tensile strength reading for a distance of 1 inch was recorded. The adhesion values obtained show the adhesive bond of the elastomer to the back and pace of the sample swatch tested..

An average tensile strength reading was taken for each side of the test swatch so tested and the average of two values is reported. Results reported as $x/y$ indicate side-to-side variations in tensile strength, that is for one side of the ply an average value $x$ was obtained; the other side of the ply yielded average value $y$.

The edge pull test was used to determine the tenacity of the exposed edge yarns to raveling. According to this procedure three 2 by 6 inch strips were cut out of both hot slit sides of a sample fabric. Next a line is drawn one inch down from the top of the example and the center of the sample is marked at the bottom. A paper clip is attached to the sample one thread above the bead in the center of the sample. The sample is then pulled on a Thwing Albert device with the necessary weights and the weight in grams required to ravel the edge is recorded. In the manner of the previous test, the difference between two edges of the sample are reported as $x/y$.

In the above examples various adhesion test stocks were used having the following compositions:

| | |
|---|---|
| EPDM TEST STOCK | |
| EPDM | 100 |
| Stearic Acid | 1 |
| ZmO | 5 |
| HAF Black | 50 |
| Naphthenic Oil | 20 |
| Monex | 1.5 |
| MBT | 0.5 |
| Sulfur | 1.5 |
| NEOPRENE TEST STOCK | |
| WRT | 100 |
| Hi Sil 233 | 45 |
| ZmO | 5 |
| Stearic Acid | 0.5 |
| Circle Oil | 20 |
| MgO | 4 |
| Zalba Special | 2 |
| NA-22 | 1.5 |
| MBTS | 1.5 |
| BUTYL TEST STOCK | |
| Butyl 218 | 100 |
| MPC Black | 45 |

-continued

| | |
|---|---|
| Elastopar | 0.5 |
| Process Oil | 10 |
| Stearic Acid | 1 |
| ZmO | 5 |
| Sulfur | 1.5 |
| MBTS | 1 |
| Tellurac | 1 |

In the above formulations Monex is tetramethyl thiuram monosulfide and MBT is 2-mercaptobenzothiazole, both of which are considered rubber accelerators. Zalba Special is a fortified phenol (an anti-oxidant) while NA-22 is 2-mercaptoimidazoline and MBTS is benzothiazyl disulfide, both accelerators. Tellurac is telluriun diethyldithio carbamate, a rubber accelerator.

What is claimed:

1. A process of bonding a woven fabric to a rubber substrate including the steps of:

(1) applying to an open mesh, woven nylon or polyester scrim fabric an elastomeric coating of a dispersion of a carboxylated chloroprene latex said latex consisting essentially of chloroprene, as the primary monomer, with from about 2 to about 5% by weight of methacrylic acid as comonomer, and having a carboxyl functionality of about 0.033/100 grams of latex solids;

(2) drying the elastomeric coating applied in step (1) thereby mechanically securing the warp and fill yarns of said fabric together at their cross over points and preventing substantial movement or distortion of the individual yarns or thread members of said fabric; and thereafter (3) contacting at least one planar surface of the coated fabric of step (2) with a rubber substrate to form a ply; and (4) curing the fabric/rubber ply of step (3) under rubber-curing conditions to cure the rubber and to form chemical bonds between said fabric and the coating elastomer thereon.

2. A process of bonding a woven fabric to a rubber substrate including the steps of:

(1) applying to an open mesh, woven nylon or polyester scrim fabric an elastomeric coating of a dispersion of a carboxylated chloroprene latex copolymer said latex consisting essentially of chloroprene, as the primary monomer, with from about 2 to about 5% by weight of methacrylic acid as comonomer, having a carbonyl functionality of about 0.033/100 grams of latex solids and a chlorine content of about 36% by weight;

(2) drying the elastomeric coating applied in step (1) thereby mechanically securing the warp and fill yarns of said fabric together at their cross over points and preventing substantial movement or distortion of the individual yarns or thread members of said fabric, and thereafter (3) contacting at least one planar surface of the coated fabric of step (2) with a rubber substrate to form a ply; and (4) curing the fabric/rubber ply of step (3) under rubber-curing conditions to cure the rubber and form chemical bonds between said fabric and the coating elastomer thereon.

* * * * *